US007165270B2

(12) United States Patent
DeYoung et al.

(10) Patent No.: US 7,165,270 B2
(45) Date of Patent: Jan. 23, 2007

(54) FOOD HOLDER

(76) Inventors: Perry R. DeYoung, 233 Deer Run Dr. NE., Ada, MI (US) 49301; Michael J. Bosscher, 8446 Cottonwood Dr., Jenison, MI (US) 49428

( * ) Notice: Subject to any disclaimer, the term of this patent is extended or adjusted under 35 U.S.C. 154(b) by 136 days.

(21) Appl. No.: 10/763,720

(22) Filed: Jan. 23, 2004

(65) Prior Publication Data

US 2005/0160512 A1 Jul. 28, 2005

(51) Int. Cl.
*A41D 13/08* (2006.01)

(52) U.S. Cl. ..... 2/16; 2/161.6

(58) Field of Classification Search ..... 2/16, 2/20, 21, 161.6; 294/25; 56/400.01
See application file for complete search history.

(56) References Cited

U.S. PATENT DOCUMENTS

| | | | | |
|---|---|---|---|---|
| 342,341 | A | 5/1886 | Edwards | |
| 580,148 | A | 4/1897 | Staples | |
| 590,347 | A | 9/1897 | Sylvestre | |
| 1,206,102 | A | 11/1916 | Gibson | |
| 1,337,957 | A | 4/1920 | Rasmussen | |
| 1,416,001 | A * | 5/1922 | Detwiler | 2/21 |
| 1,955,989 | A | 4/1934 | Uhri | |
| 1,990,553 | A | 2/1935 | Koffler et al. | |
| 2,025,357 | A | 12/1935 | Pagan | |
| 2,047,635 | A | 7/1936 | Johst | |
| 2,244,072 | A | 6/1941 | Ledbetter | |
| 2,501,571 | A * | 3/1950 | Liedtke | 2/161.6 |
| 2,701,361 | A * | 2/1955 | Depta, Jr. | 2/20 |
| 2,717,799 | A | 9/1955 | Jones | |
| 2,881,022 | A | 4/1959 | Brust | |
| D188,383 | S | 7/1960 | Gravning | |
| 3,181,198 | A | 5/1965 | Stelzen | |
| 3,331,626 | A | 7/1967 | Kaufman | |
| 3,407,927 | A | 10/1968 | Jones | |
| 3,837,696 | A | 9/1974 | Dahlke | |
| 3,975,043 | A | 8/1976 | Miles | |
| 4,188,055 | A | 2/1980 | Green | |
| 4,454,624 | A | 6/1984 | Vandermer | |
| 4,494,785 | A | 1/1985 | Song | |
| 4,507,804 | A | 4/1985 | Consigny | |
| 4,511,039 | A | 4/1985 | Siemek | |
| 4,682,803 | A | 7/1987 | Andrews | |
| 4,766,612 | A | 8/1988 | Patton, Sr. | |

(Continued)

FOREIGN PATENT DOCUMENTS

| | | | |
|---|---|---|---|
| JP | 406205723 | A | 7/1994 |

*Primary Examiner*—Katherine M. Moran
(74) *Attorney, Agent, or Firm*—Price, Heneveld, Cooper, DeWitt & Litton, LLP

(57) ABSTRACT

A food holder comprising a substantially symmetrical U-shaped body having a pair of opposite digit pockets for accepting fingers or a thumb of a user of the food holder therein and a food pocket located between the digit pockets. The digit pockets taper to accept the fingers or thumb placed therein and to frictionally connect the food holder to a hand of the user. An exterior surface of the digit pockets has elongated ridges to prevent cutting of the surface and into the interior of the pockets during use of the food holder. The food holder is used to hold food by placing the food within the food pocket and moving the digit pockets towards each other. The food holder is preferably used to hold food while the food is being cut.

9 Claims, 3 Drawing Sheets

U.S. PATENT DOCUMENTS

| | | | | | |
|---|---|---|---|---|---|
| 4,854,624 | A | | 8/1989 | Baymiller | |
| 5,149,159 | A | | 9/1992 | Bardes | |
| 5,222,777 | A | | 6/1993 | Clonch | |
| 5,359,840 | A | * | 11/1994 | Costar | 56/400.12 |
| D368,330 | S | | 3/1996 | Robinson | |
| 5,709,423 | A | | 1/1998 | Romero | |
| 5,711,027 | A | | 1/1998 | Katz et al. | |
| D391,029 | S | | 2/1998 | Katz et al. | |
| D414,300 | S | | 9/1999 | Silvey | |
| D415,321 | S | | 10/1999 | Silvey | |
| D418,258 | S | | 12/1999 | Moro | |
| D425,261 | S | | 5/2000 | Basile | |
| D433,196 | S | | 10/2000 | Specht | |
| 6,145,128 | A | | 11/2000 | Suzuki | |
| D470,980 | S | | 2/2003 | Bignon et al. | |
| 6,532,597 | B1 | * | 3/2003 | Bignon et al. | 2/161.6 |
| D477,690 | S | | 7/2003 | Howell et al. | |
| 2003/0131393 | A1 | * | 7/2003 | Votolato | 2/16 |

* cited by examiner

FOOD HOLDER

BACKGROUND OF THE INVENTION

The present invention relates to a food holder, and in particular to a food holder used to hold bread during slicing of the bread.

In some sit-down restaurants, patrons of the restaurant receive fresh, hot bread along with their meals. In some of these restaurants, the bread is sliced just prior to being served.

Heretofore, latex gloves and wax paper have typically been used to hold the bread as the bread (or other ready-to-eat food) was sliced by a restaurant employee to provide a sanitary barrier between the skin of the employee and the bread (or other ready-to-eat food). Typically, the wax paper is only used once and therefore the cost for providing freshly sliced bread can become expensive. Furthermore, putting on latex gloves can be time consuming and a distraction for the patrons of the restaurant. Finally, the gloves and wax paper provide little or no protection against accidental skin lacerations from knives used to cut the bread, and are not a very good thermal barrier for hot or warm food.

Accordingly, a food holder solving the aforementioned disadvantages and having the aforementioned advantages is desired.

SUMMARY OF THE INVENTION

One aspect of the present invention is to provide a food holder comprising a substantially symmetrical U-shaped body having a pair of opposite digit pockets for accepting fingers or a thumb of a user of the food holder therein and a food pocket located between the digit pockets. The digit pockets taper to accept the fingers or thumb placed therein and to frictionally connect the food holder to a hand of the user. An exterior surface of the digit pockets has elongated ridges to prevent cutting of the surface and into the interior of the pockets during use of the food holder.

Another aspect of the present invention is to provide a method of grabbing food comprising providing a food holder having a substantially symmetrical U-shaped body including a pair of opposite digit pockets and a food pocket located between the digit pockets, with the digit pockets tapering, and with an exterior surface of the digit pockets having elongated ridges. The method further includes placing fingers in a first one of the digit pockets and placing a thumb in a second one of the digit pockets to frictionally connect the food holder to a user. The method also includes placing food within the food pocket and moving the digit pockets towards each other to capture the food within the food pocket.

Yet another aspect of the present invention is to provide a method of cutting food comprising providing a food holder having a substantially symmetrical U-shaped body including a pair of opposite digit pockets and a food pocket located between the digit pockets, with the digit pockets tapering, and with an exterior surface of the digit pockets having elongated ridges to prevent cutting of the surface and into an interior of the pockets. The method further includes placing fingers in a first one of the digit pockets and placing a thumb in a second one of the digit pockets to frictionally connect the food holder to a user. The method also includes placing food within the food pocket, moving the digit pockets towards each other to capture the food within the food pocket and cutting the food.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
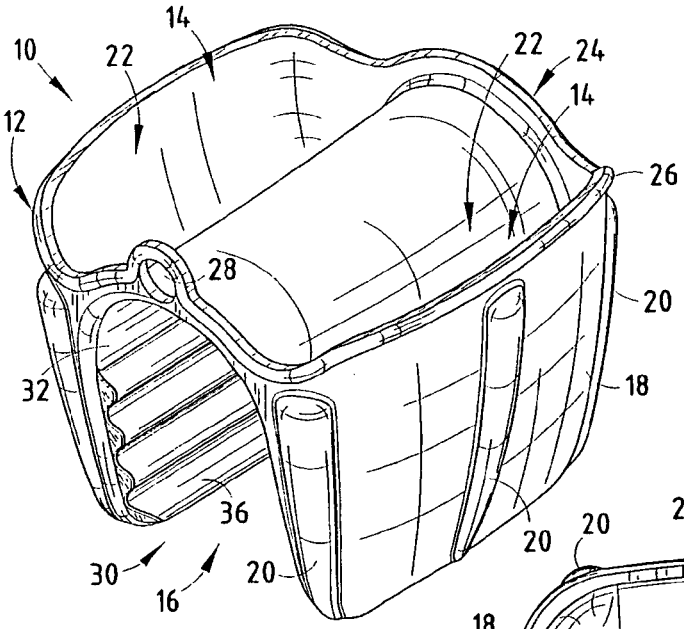
FIG. 1 is a perspective view of a food holder of the present invention.
Figure 2:
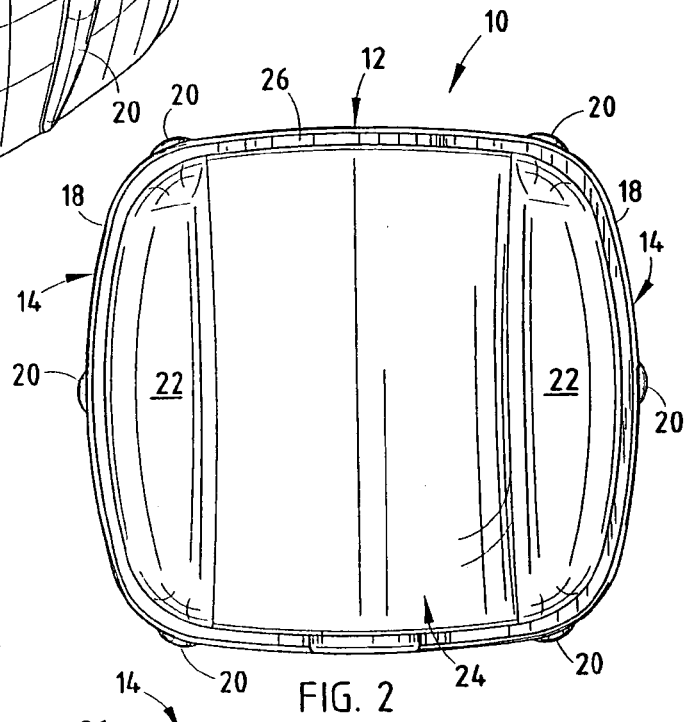
FIG. 2 is a top view of the food holder of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a food holder. The food holder 10 comprises a substantially symmetrical U-shaped body 12 having a pair of opposite digit pockets 14 for accepting fingers or a thumb of a user of the food holder 10 therein and a food pocket 16 located between the digit pockets 14. The digit pockets 14 taper to accept the fingers or thumb placed therein and to frictionally connect the food holder 10 to a hand of the user. An exterior surface 18 of the digit pockets 14 has elongated ridges 20 to prevent cutting of the surface 18 and into an interior of the digit pockets 14 during use of the food holder 10.

The illustrated food holder 10 is made of a flexible material to allow the digit pockets 14 to be moved towards each other to thereby hold food within the food pocket 16. The food holder 10 is preferably molded as a unitary piece of silicone. The food holder 10 is preferably safe to use in a dishwasher daily having temperatures up to at least 180° F. Furthermore, the food holder 10 preferably provides a thermal barrier between food placed in the food pocket 16 and the fingers and thumb placed in the digit pockets 14. Preferably, the food holder 10 provides a thermal barrier of up to 140° F.

Figure 3:
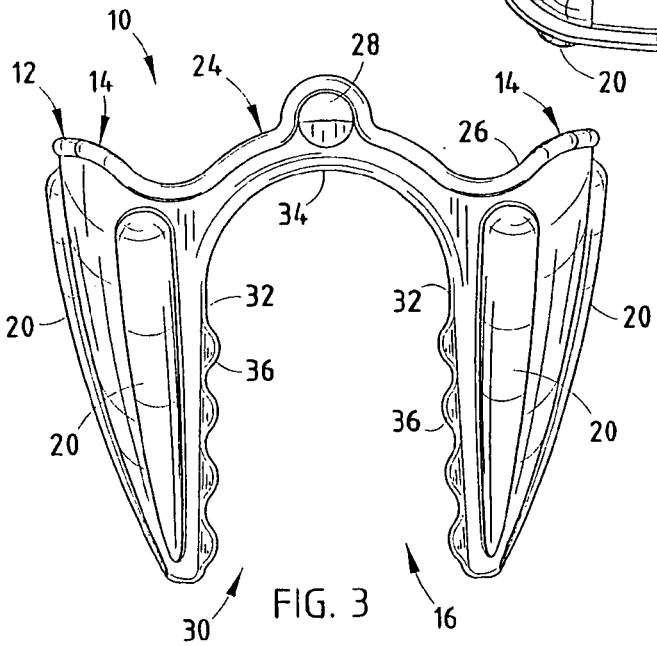
FIG. 3 is a left side view of the food holder of the present invention.
Figure 4:
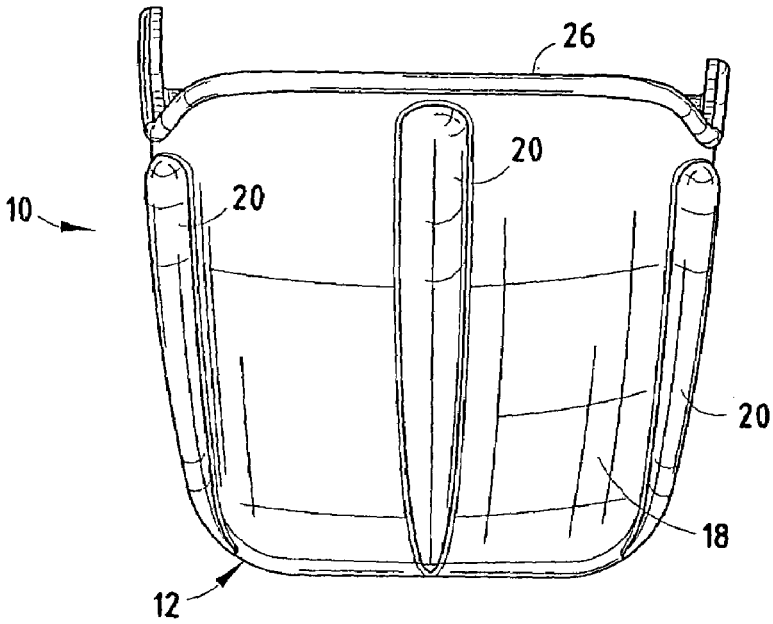
FIG. 4 is a front view of the food holder of the present invention.
Figure 5:
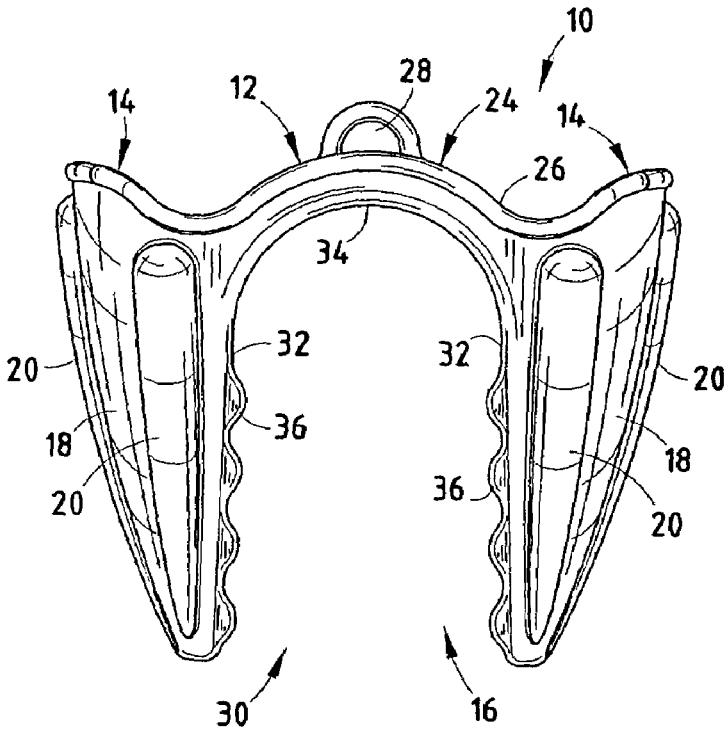
FIG. 5 is a right side view of the food holder of the present invention.
Figure 6:
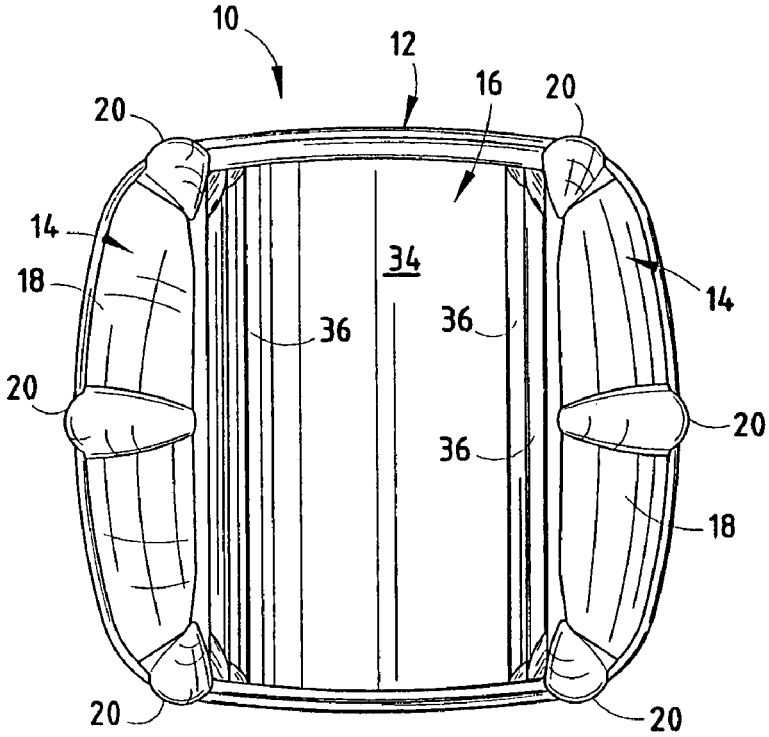
FIG. 6 is a bottom view of the food holder of the present invention.

In the illustrated example, the digit pockets 14 are configured to accept fingers and a thumb therein during use of the food holder 10. Each of the digit pockets 14 include an interior 22 for accepting the fingers or the thumb and the exterior surface 18 having the elongated ridges 20 thereon. Preferably, four fingers of one hand of a user of the food holder 10 is placed in a first one of the digit pockets 14 and the thumb of the one hand of the user of the food holder 10 is placed in a second one of the digit pockets 14. The digit pockets 14 have an opening larger than a bottom of the digit pockets 14 to thereby taper to accept the fingers or thumb placed therein and to frictionally connect the food holder 10 to a hand of the user. The digit pockets 14 taper in a tapering direction and the ridges 20 have a longer dimension in the tapering direction than in a direction perpendicular to the tapering direction (see FIGS. 3 and 5). The elongated ridges 20 are preferably bullet shaped. However, it is contemplated that the ridges 20 could have any shape. Furthermore, although three ridges 20 are shown on the exterior surface 18 of each digit pocket 14, it is contemplated that any number of ridges 20 could be used on the exterior surface 18 of each digit pocket 14. The digit pockets 14 preferably include a bridge section 24 extending therebetween and located behind the food pocket 16. An enlarged lip 26 extends around the opening of the digit pockets 14 and the bridge section 24. The bridge section 24 preferably includes an opening 28 for allowing the food holder 10 to be hung from a hook (not shown).

The illustrated food pocket 16 of the food holder 10 accepts food therein. The food pocket 16 includes an open front 30, a pair of side walls 32 (defined by the digit pockets 14) and a closed rear 34. The food pocket 16 preferably tapers inwardly such that the open front 30 is larger than the closed rear 34. The side walls 32 of the food pocket 16 are preferably corrugated to define a plurality of grabbing ribs 36 on each side wall 32. The grabbing ribs 36 are preferably parallel and have a longer dimension that extends in the direction perpendicular to the tapering direction. Although four ribs 36 are shown on each side wall 32 of the food pocket 16, it is contemplated that any number of ribs 36 could be used on each side wall 32 of the food pocket 16.

Figure 7:
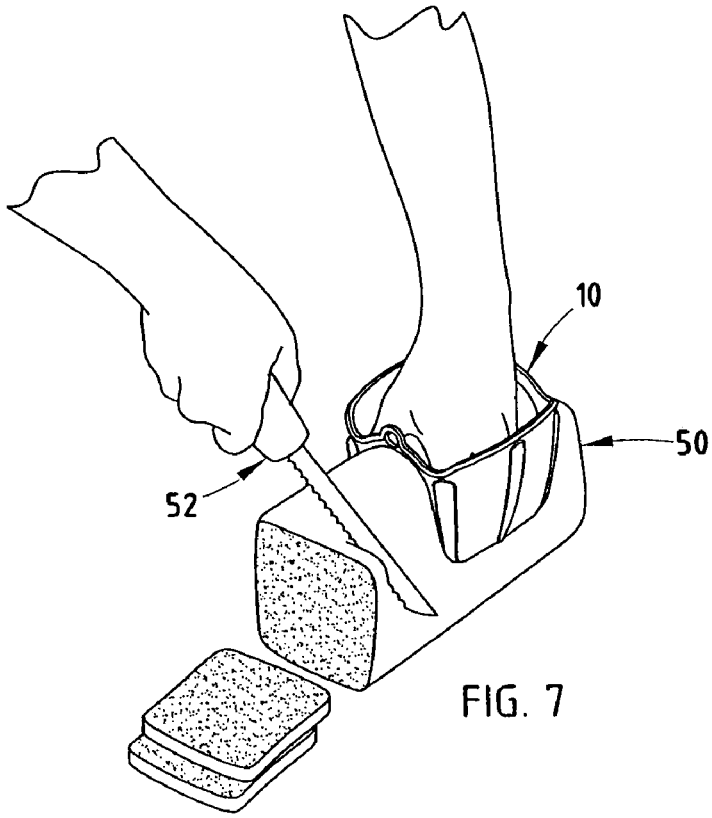
FIG. 7 is a perspective view of a use of the food holder of the present invention.

As illustrated in FIG. 7, the food holder 10 is used to grab food. Preferably, the food holder 10 is used to grab and cut bread 50. However, the food holder 10 can be used to hold any type of food (e.g., meat). During use, a user of the food holder 10 uses the food holder 10 by placing fingers in a first one of the digit pockets 14 and placing a thumb in a second one of the digit pockets 14 to frictionally connect the food holder 10 to the user's hand. Thereafter, the food pocket 16 is moved over food (shown as bread 50) to place the food within the food pocket 16. Furthermore, the user of the food holder 10 moves the digit pockets 14 towards each other to capture the food within the food pocket 16. The food in the food pocket 16 can then be easily moved and cut with a knife 52.

The food holder 10 of the present invention provides a sanitary barrier between the hand of the user of the food holder 10 and the food placed within the food pocket 16 of the food holder 10. Preferably, the food holder 10 is used in a restaurant to grab bread and to cut the bread for customers of the restaurant. The food holder 10 includes ridges 20 to help prevent accidental cutting of the exterior surface 18 of the digit pockets 14, thereby preventing accidental skin lacerations of the fingers or thumbs of the user of the food holder 10. The food holder 10 can be used to hold warm bread, can easily be used with a left or right hand, can be washed and is reusable.

The above description is considered that of the preferred embodiments only.

Modifications of the invention will occur to those skilled in the art and to those who make or use the invention. Therefore, it is understood that the embodiments shown in the drawings and described above are merely for illustrative purposes and not intended to limit the scope of the invention.

Moreover, the foregoing detailed description is considered that of a preferred embodiment only, and the particular shape and nature of at least some of the components in this embodiment are at least partially based on manufacturing advantages and considerations as well as on those pertaining to assembly and operation. Modifications of this embodiment may well occur to those skilled in the art and to those who make or use the invention after learning the nature of this preferred embodiment, and the invention lends itself advantageously to such modification and alternative embodiments. Therefore, it is to be understood that the embodiment shown in the drawings and described above is provided principally for illustrative purposes and should not be used to limit the scope of the invention.

As will be seen and appreciated by those skilled in the art, the present invention contemplates the following major points of achievement, as well as others inherent in the disclosure.

We claim:

1. A food holder comprising:

a substantially symmetrical U-shaped body comprising a pair of opposite digit pockets for accepting fingers or a thumb of a user of the food holder therein and a food pocket located between the digit pockets;

the digit pockets tapering to accept the fingers or thumb placed therein and to frictionally connect the food holder to a hand of the user; and an exterior surface of the digit pockets having elongated ridges to prevent cutting of the surface and into an interior of the digit pockets during use of the food holder;

wherein the food pocket defines an opening having an open front and a closed rear;

wherein opposite sides of the digit pockets defining the food pocket include grabbing ribs for maintaining food within the food pocket as the digit pockets are moved toward each other;

wherein the digit pockets taper in a tapering direction and ridges have a longer dimension in the tapering direction than in a direction perpendicular to the tapering direction; and wherein the grabbing ribs have a longer dimension in the direction perpendicular to the tapering direction than in the tapering direction.

2. The food holder of claim 1, wherein:

the food pocket defines an inwardly tapering opening.

3. The food holder of claim 1, wherein:

the ridges of the digit pockets are made of material thicker than areas of the digit pockets surrounding the ridges.

4. A method of grabbing food comprising:

providing a food holder comprising a substantially symmetrical U-shaped body having a pair of opposite digit pockets and a food pocket located between the digit pockets, with the digit pockets tapering, and with an exterior surface of the digit pockets having elongated ridges;

placing fingers in a first one of the digit pockets and placing a thumb in a second one of the digit pockets to frictionally connect the food holder to a user;

placing food within the food pocket; and moving the digit pockets towards each other to capture the food within the food pocket;

wherein the food pocket defines an opening having an open front and a closed rear;

wherein opposite sides of the digit pockets defining the food pocket include grabbing ribs for maintaining the food within the food pocket as the digit pockets are moved toward each other;

wherein the digit pockets taper in a tapering direction and ridges have a longer dimension in the tapering direction than in a direction perpendicular to the tapering direction; and wherein the grabbing ribs have a longer dimension in the direction perpendicular to the tapering direction than in the tapering direction.

5. The method of grabbing food of claim 4, wherein:

the food pocket defines an inwardly tapering opening.

6. The method of food grabbing of claim 4, wherein:

the ridges of the digit pockets are made of material thicker than areas of the digit pockets surrounding the ridges.

7. A method of cutting food comprising:

providing a food holder comprising a substantially symmetrical U-shaped body having a pair of opposite digit pockets and a food pocket located between the digit pockets, with the digit pockets tapering, and with an exterior surface of the digit pockets having elongated ridges to prevent cutting of the surface and into an interior of the digit pockets during use of the food holder;

placing fingers in a first one of the digit pockets and placing a thumb in a second one of the digit pockets to frictionally connect the food holder to a user;

placing food within the food pocket;

moving the digit pockets towards each other to capture the food within the food pocket; and cutting the food;

wherein the food pocket defines an opening having an open front and a closed rear;

wherein opposite sides of the digit pockets defining the food pocket include grabbing ribs for maintaining the food within the food pocket as the digit pockets are moved toward each other;

wherein the digit pockets taper in a tapering direction and ridges have a longer dimension in the tapering direction than in a direction perpendicular to the tapering direction; and wherein the grabbing ribs have a longer dimension in the direction perpendicular to the tapering direction than in the tapering direction.

8. The method of cutting food of claim 7, wherein:

the food pocket defines an inwardly tapering opening.

9. The method of food cutting of claim 7, wherein:

the ridges of the digit pockets are made of material thicker than the areas of the digit pockets surrounding the ridges.

* * * * *